US008498438B2

(12) United States Patent
Akino

(10) Patent No.: US 8,498,438 B2
(45) Date of Patent: Jul. 30, 2013

(54) CONDENSER MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 195 days.

(21) Appl. No.: 12/926,305

(22) Filed: Nov. 9, 2010

(65) Prior Publication Data

US 2011/0142264 A1 Jun. 16, 2011

(30) Foreign Application Priority Data

Dec. 11, 2009 (JP) ..... 2009-281193

(51) Int. Cl.
*H04R 11/04* (2006.01)
*H04R 17/02* (2006.01)

(52) U.S. Cl.
USPC ..... 381/363; 381/361

(58) Field of Classification Search
USPC ..... 381/174, 189, 361–368
See application file for complete search history.

(56) References Cited

U.S. PATENT DOCUMENTS

| | | | | |
|---|---|---|---|---|
| 5,604,814 | A * | 2/1997 | Chen et al. | 381/361 |
| 5,731,629 | A * | 3/1998 | Woodward | 257/679 |
| 6,739,885 | B2 * | 5/2004 | Ward et al. | 439/108 |
| 6,961,437 | B2 * | 11/2005 | Kondo et al. | 381/174 |
| 7,330,559 | B2 * | 2/2008 | Akino | 381/363 |
| 2005/0254679 | A1 * | 11/2005 | Akino | 381/390 |

* cited by examiner

*Primary Examiner* — Fan Tsang
*Assistant Examiner* — Eugene Zhao
(74) *Attorney, Agent, or Firm* — Manabu Kanesaka

(57) ABSTRACT

There is provided a gooseneck condenser microphone that is further strengthened the shield structure of a support pipe and is less prone to causing a trouble. This condenser microphone has a support pipe 30 for supporting a condenser microphone unit 10 and an output module part 20, a microphone cable 40 in which a shielding wire 44 is exposed is inserted in the support pipe 30, and a conductive sealant agent 50 is filled in a void between the microphone cable 40 and the support pipe 30.

3 Claims, 2 Drawing Sheets

CONDENSER MICROPHONE

CROSS-REFERENCE TO RELATED APPLICATION

The present application is based on, and claims priority from, Japanese Application Serial Number JP2009-281193, filed Dec. 12, 2009, the disclosure of which is hereby incorporated by reference herein in its entirety.

TECHNICAL FIELD

The present invention relates to a gooseneck condenser microphone provided with a condenser microphone unit at the tip end of a support pipe including a flexible pipe and, more particularly, to strengthening of a shield structure in a support pipe part.

BACKGROUND ART

For example, as described in Japanese Patent Application Publication No. 2006-33216, in a gooseneck condenser microphone, a microphone unit is attached to the distal end of a support pipe in which a flexible pipe is used partially, and a connector terminal incorporating a power module for the microphone unit is provided on the rear end side of the support pipe.

This gooseneck microphone is configured so that the direction of the microphone unit can be changed freely by flexing the flexible pipe. Also, because of its small size and good appearance, the gooseneck microphone has come into wide use mainly as conference equipment.

Usually, in the condenser microphone, a field effect transistor (FET) serving as an impedance converter is incorporated, and the condenser microphone unit and an output module are connected to each other via a microphone cable.

As the microphone cable, there has been used a two-core shielding covered cable having a power line for supplying power, a signal line for sending signals to the output module, a shielding wire for electrostatically shielding these lines, and an external sheath (skin) for covering the shielding wire.

Since sound signals are sent imbalancedly in the portion of microphone cable, the microphone cable is vulnerable to extraneous noise (electromagnetic waves). That is, if strong electromagnetic waves are applied to the microphone cable, a high-frequency current intrudes into the unit part and the power module part, and noise is generated. In particular, with the recent widespread use of cellular phones, such a trouble occurs often when a cellular phone is used in the vicinity of the microphone, which poses a big problem.

To solve this problem, in the condenser microphone disclosed in Japanese Patent Application Publication No. 2006-33216, the microphone cable is inserted in the support pipe in the state in which the external sheath is not provided and the shielding wire is exposed. According to this configuration, the shielding wire and the inner peripheral surface of support pipe are connected electrically to each other at multiple contact points, so that the resistance value of support pipe decreases extremely, and the shieldability against electromagnetic waves is improved significantly.

Unfortunately, the condenser microphone disclosed in Japanese Patent Application Publication No. 2006-33216 has problems described below. Since the flexible pipe is capable of being flexed, both of the position and the number of contact points between the support pipe and the shielding wire are unspecified, so that differences in shieldability among individual microphone cables are liable to occur.

Also, when the gooseneck portion is flexed repeatedly, metal powder is produced by intermetallic friction between the support pipe and the shielding wire. The metal powder drops into the power module part, which may cause a short-circuit accident.

Further, since the flexible pipe consists of a combination of steel wires and copper wires, rusting takes place due to a potential difference between dissimilar metals, and the rust may exert an influence on the shieldability.

Besides, since the interior of the support pipe is a cavity, sounds pass through the interior of the support pipe and intrude into the microphone unit, so that noise due to cavity resonance may be generated.

The present invention has been made to solve the above problems, and accordingly an object thereof is to provide a gooseneck condenser microphone that is further strengthened the shield structure of a support pipe and is less prone to causing a trouble.

SUMMARY OF THE INVENTION

To achieve the above object, the present invention has some features described below. In a condenser microphone including a condenser microphone unit and an output module part provided with a circuit board for sending sound signals in a shield casing, the condenser microphone unit being supported on the output module part via a support pipe including a flexible pipe, the condenser microphone unit and the circuit board being electrically connected to each other via a microphone cable having a shielding wire inserted in the support pipe, and the shielding wire of the microphone cable being exposed at least in a portion such as being arranged in the support pipe and being in electrical contact with the inner surface of the support pipe, a conductive sealant agent is filled in a void between the microphone cable and the support pipe.

Also, the present invention embraces a method for manufacturing the condenser microphone. In the method for manufacturing a condenser microphone including a condenser microphone unit and an output module part provided with a circuit board for sending sound signals in a shield casing, the condenser microphone unit being supported on the output module part via a support pipe including a flexible pipe, the condenser microphone unit and the circuit board being electrically connected to each other via a microphone cable having a shielding wire inserted in the support pipe, and the shielding wire of the microphone cable being exposed at least in a portion such as being arranged in the support pipe and being in electrical contact with the inner surface of the support pipe, the microphone cable is inserted from one end side of the support pipe and pulled out from the other end side thereof, the tip end of an injector for injecting a conductive sealant agent is inserted from one end side of the support pipe and pulled out to the other end side thereof, and then the conductive sealant agent is filled in a void between the microphone cable and the support pipe while the injector is pulled back to one end side of the support pipe.

According to the present invention, since the sealant agent having electric conductivity is filled in a void between the microphone cable in which the shielding wire is exposed and the support pipe, the electric conduction between the shielding wire and the support pipe is made more reliable, and the shielding effect can be enhanced further. Also, even if metal powder and the like are produced, since the sealant agent is filled, there is no fear that the metal powder drops into the power module part. Further, since the void of the support pipe is filled with the sealant agent, cavity resonance can also be prevented.

DETAILED DESCRIPTION

Figure 1:
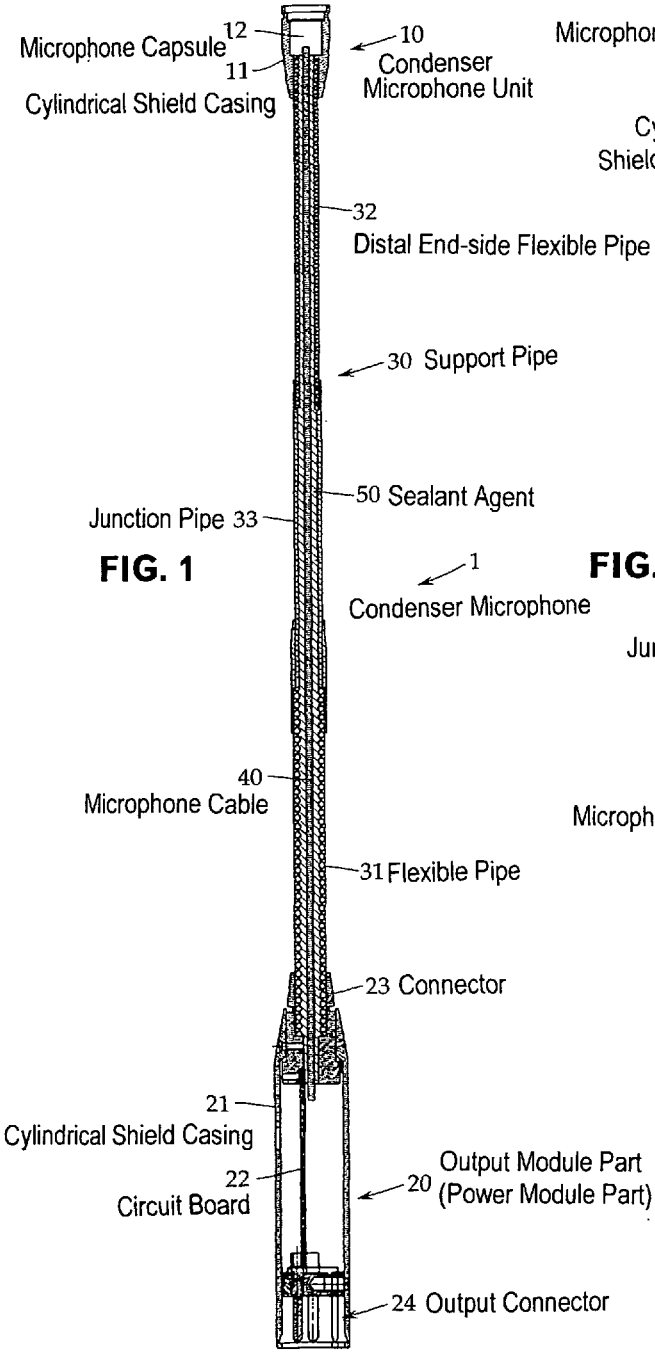
FIG. 1 is a sectional view of a gooseneck condenser microphone in accordance with one embodiment of the present invention.
Figure 2:
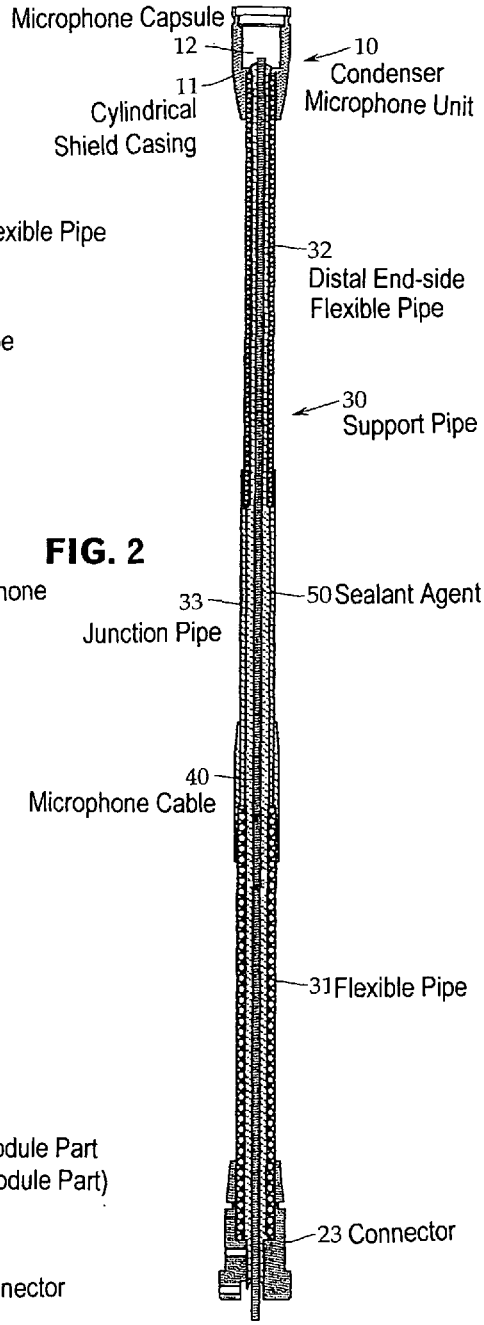
FIG. 2 is an enlarged sectional view of an essential portion of the condenser microphone shown in FIG. 1.

An embodiment of the present invention will now be described with reference to the accompanying drawings. The present invention is not limited to this embodiment. As shown in FIG. 1, a condenser microphone 1 includes a condenser microphone unit 10, an output module part (power module part) 20, and a support pipe 30 for supporting the condenser microphone unit 10.

The condenser microphone unit 10 has a cylindrical shield casing 11 formed of, for example, brass, and a microphone capsule 12 is mounted in the tip end portion of the shield casing 11.

Although not shown, a diaphragm and a backplate are contained in the microphone capsule 12 in an opposed state. As a polarization material, an electret may be used. Although not shown similarly, a field effect transistor (FET) serving as an impedance converter, electrically connected to the backplate, is housed in the shield casing 11.

The output module part 20 has a cylindrical shield casing 21 that is also used as a support base. This shield casing 21 is also formed of a conductive material such as brass. In the shield casing 21, a circuit board 22 having a sound output circuit (not shown) including a filter circuit, an amplification circuit, and the like is housed. The shield casing 21 is configured so as to be placed on a table via a suitable receiving member or the like.

On one end side (the upper end side in this example) of the shield casing 21, a connector 23 for fittingly fixing the support pipe 30 is provided. On the other end side (the lower end side in this example) of the shield casing 21, an output connector 24 is mounted.

In this example, as the output connector 24, a three-pin type output connector specified in EIAJ-RC-5236 "Latch Lock Type Round Connector for Audio Equipment" is used. The output connector 24 is connected to a phantom power source via a balanced shielded cable (both not shown).

The support pipe 30 consists of a connected pipe in which two flexible pipes, that is, a proximal end-side flexible pipe 31 and a distal end-side flexible pipe 32, are connected to each other by a junction pipe 33. However, the whole of the support pipe 30 may be configured by a flexible pipe.

In this example, the proximal end-side flexible pipe 31 has a larger diameter than the distal end-side flexible pipe 32. This is because of a demand in design. Each of the flexible pipes 31 and 32 is manufactured by forming a coil spring for providing restoring force by using a round wire rod of steel or the like and by inserting from above a triangular wire rod having a triangular cross section and consisting of a steel alloy or the like, which is plastically deformed, into the gap of the coil spring. According to this configuration, since the round wire rod and the triangular wire rod have high friction, the flexible pipes can be deformed at an arbitrary position, and the deformed state can be kept by itself.

Figure 3:
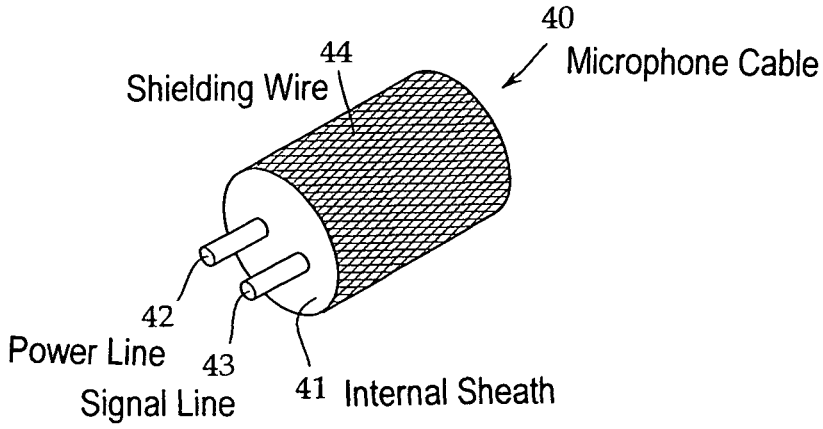
FIG. 3 is a schematic view of a microphone cable.

In the support pipe 30, a microphone cable 40 for electrically connecting the condenser microphone unit 10 to the output module part 20 is inserted. As shown in FIG. 3, the microphone cable 40, which is a two-core shielding covered cable, includes a power line 42 and a signal line 43, both being inserted in an internal sheath 41, and a shielding wire 44 of, for example, a mesh form, which is wound on the whole outer peripheral surface of the internal sheath 41.

For the cable having the shielding wire 44, not being limited to the microphone cable 40, usually, the shielding wire 44 is covered with an external sheath (skin) throughout the overall length. In the present invention, however, for the microphone cable 40, at least in a portion disposed on the inside of the support pipe 30, the external sheath is removed, and the shielding wire 44 is exposed so as to be an outermost layer.

According to this configuration, since the shielding wire 44 of the microphone cable 40 is electrically connected to the inner peripheral surface of the support pipe 30 at multiple points, many short circuit-like closed circuits are formed in the connecting portions between the shielding wire 44 and the support pipe 30. Therefore, even if a high-frequency current flows in the support pipe 30 on account of strong electromagnetic waves, the high-frequency current is converted into thermal energy by the short circuit-like closed circuits and disappears. Thereby, the generation of noise due to electromagnetic waves is restrained.

In the present invention, the support pipe 30 is further filled with a sealant agent 50 having electric conductivity. The conductive sealant agent 50, which is formed by blending conductive powder such as carbon with a base material of, for example, a silicone rubber compound, has electric conductivity while holding moderate elasticity. As the conductive sealant agent 50, for example, KE3491 or KE3492 manufactured by Shin-Etsu Silicone Co., Ltd. is suitably used.

The conductive sealant agent 50 of this kind, which is stored in a container such as a tube or a cartridge in a liquid or gel form, is injected into a designated portion, and is cured by being allowed to stand for a certain period of time.

By filling the conductive sealant agent 50 in a void between the support pipe 30 and the microphone cable 40, the electric conduction area between the support pipe 30 and the microphone cable 40 can be increased reliably, and the shieldability can be enhanced further.

Even if metal powder and the like are produced, since the sealant agent is filled, there is no fear that the metal powder drops into the power module part. Further, since the support pipe is filled with the sealant agent, cavity resonance can also be prevented.

In order to fill the conductive sealant agent 50 in the void between the support pipe 30 and the microphone cable 40, first, an injection needle or a thin tube (both not shown) is attached to the tip end of a cartridge type injector in which the uncured conductive sealant agent 50 is filled.

Next, the tip end of the injection needle or the tube is inserted from one end side of the support pipe 30, and is inserted farther toward the other end side thereof. After it has been checked that the tip end has arrived at the other end side of the support pipe 30, the injection needle or the tube is pulled back while the conductive sealant agent 50 is injected gradually from the injector. The conductive sealant agent 50 is injected while the injection needle or the tube is pulled back to the insertion side.

According to this method, even if the gap between the support pipe 30 and the microphone cable 40 is very narrow, the conductive sealant agent 50 having high viscosity can be filled reliably. In this example, in the state in which the microphone cable 40 has been inserted into the support pipe 30 in advance, the filling tube is inserted into the support pipe 30 and fills the conductive sealant agent 50 while being pulled back. Besides, a method can be used in which the filling tube is fixed to one end of the microphone cable 40 in advance, and the microphone cable 40 and the filling tube are inserted at the same time.

The invention claimed is:

1. A condenser microphone comprising:

a condenser microphone unit having a shield casing, an output module part provided with a circuit board for sending sound signals in the shield casing, a support pipe including a flexible pipe, and arranged between the condenser microphone unit and the output module part to support the condenser microphone unit thereon, a microphone cable arranged in the support pipe and electrically connecting the circuit board and the condenser microphone unit, the microphone cable having a power line, a signal line, an internal sheath, and a shielding wire disposed outside the internal sheath without having an external sheath thereon along an entire length in the support pipe, and a conductive sealant agent having a base material mixed with conductive powder and filled in an entire void between the shielding wire of the microphone cable and the flexible pipe to electrically connect the shielding wire and the flexible pipe.

2. A condenser microphone according to claim 1, wherein the conductive sealant agent includes a base material having elasticity and a conductive powder in the base material.

3. A condenser microphone according to claim 2, wherein the conductive sealant is arranged entirely outside the shielding wire to electrically contact an entire inner surface of the support pipe and the shielding wire to prevent cavity resonance.

* * * * *